US011377289B2

(12) United States Patent
Romeo et al.

(10) Patent No.: US 11,377,289 B2
(45) Date of Patent: Jul. 5, 2022

(54) CONTAINER FOR MEDICAL AND/OR PHARMACEUTICAL PRODUCTS

(71) Applicant: AIRNOV, INC., New Castle, DE (US)

(72) Inventors: Bernardo Romeo, Paris (FR); Valere Logel, Perret (FR); Jacquy Lebon, Challans (FR)

(73) Assignee: AIRNOV, INC., New Castle, DE (US)

( * ) Notice: Subject to any disclaimer, the term of this patent is extended or adjusted under 35 U.S.C. 154(b) by 0 days.

(21) Appl. No.: 16/486,816

(22) PCT Filed: Feb. 21, 2018

(86) PCT No.: PCT/EP2018/054228

§ 371 (c)(1),
(2) Date: Aug. 16, 2019

(87) PCT Pub. No.: WO2018/153890

PCT Pub. Date: Aug. 30, 2018

(65) Prior Publication Data

US 2019/0367247 A1 Dec. 5, 2019

(30) Foreign Application Priority Data

Feb. 24, 2017 (FR) ..... 1751525

(51) Int. Cl.
*B65D 81/26* (2006.01)
*B65D 41/34* (2006.01)
(Continued)

(52) U.S. Cl.
CPC ..... *B65D 81/266* (2013.01); *B65D 41/3447* (2013.01); *B65D 41/485* (2013.01);
(Continued)

(58) Field of Classification Search
CPC .... B65D 41/34; B65D 41/3447; B65D 41/48; B65D 41/485; B65D 43/02;
(Continued)

(56) References Cited

U.S. PATENT DOCUMENTS 2,270,603 A * 1/1942 Ridder ..... A24F 25/02 206/205
4,205,750 A * 6/1980 Dews ..... B65D 77/06 206/540
(Continued)

FOREIGN PATENT DOCUMENTS

CN 101052572 A 10/2007
CN 201154785 Y 11/2008
(Continued)

OTHER PUBLICATIONS

IN 201917035238—Examination Report dated Jun. 7, 2021, 6 pages.

*Primary Examiner* — Bryon P Gehman
(74) *Attorney, Agent, or Firm* — Haynes Beffel & Wolfeld LLP; Andrew Dunlap

(57) ABSTRACT

The disclosure pertains to a container for storing medical and/or pharmaceutical products. The container includes a plastic container body comprising a side wall, a base and an opening defining a storage volume, a flange formed on the container body and configured to receive a connecting element of a cap provided with a tamper-evident mechanism, and an active insert placed within the container body. This container is an improved container for the storage of products. The disclosure also pertains to a sealed package comprising this container.

25 Claims, 9 Drawing Sheets

(51) Int. Cl.
*B65D 41/48* (2006.01)
*B65D 43/02* (2006.01)

(52) U.S. Cl.
CPC .... *B65D 43/0249* (2013.01); *B65D 2251/023* (2013.01); *B65D 2251/105* (2013.01); *B65D 2401/20* (2020.05); *B65D 2585/56* (2013.01)

(58) Field of Classification Search
CPC .... B65D 43/0249; B65D 47/08; B65D 51/24; B65D 51/26; B65D 53/00; B65D 53/02; B65D 81/26; B65D 81/265; B65D 81/266; B65D 2251/023; B65D 2251/105; B65D 2401/20; B65D 2585/56; B65D 2101/003
USPC ..... 206/204, 205, 540
See application file for complete search history.

(56) References Cited

U.S. PATENT DOCUMENTS 5,911,937 A * 6/1999 Hekal ..... B65D 81/266 206/204
5,938,012 A * 8/1999 Yeager ..... B65D 81/2084 206/205
6,050,400 A * 4/2000 Taskis ..... B65D 77/04 206/204
8,757,369 B2 * 6/2014 Portier ..... B65D 51/30 206/204
8,783,485 B2 7/2014 Logel et al.
8,789,692 B2 * 7/2014 Chang ..... B65D 43/162 206/204
8,875,917 B2 11/2014 Lourenco et al.
9,861,926 B2 * 1/2018 Lebon ..... B65D 41/48
10,246,241 B2 * 4/2019 Logel ..... B65D 81/266
10,773,869 B2 * 9/2020 Logel ..... B65D 51/244
2007/0272646 A1 11/2007 Lancesseur et al.
2010/0044252 A1 * 2/2010 Portier ..... B65D 51/26 206/204
2010/0140116 A1 * 6/2010 Stiene ..... B65D 81/266 206/204
2015/0259115 A1 * 9/2015 Yeh ..... B65D 51/30 206/204
2016/0101914 A1 4/2016 Logel et al.

FOREIGN PATENT DOCUMENTS

DE 19842073 A1 3/2000
EP 2277799 B1 2/2012
EP 3081505 A1 10/2016
JP 2006117305 A 5/2006
WO 1992019136 A1 11/1992
WO 96/27533 A1 9/1996
WO WO-9627533 A1 * 9/1996 ..... B65D 41/485
WO 96/33108 A1 10/1996
WO 2014/177900 A1 11/2014
WO 2016/135226 A1 9/2016

* cited by examiner

CONTAINER FOR MEDICAL AND/OR PHARMACEUTICAL PRODUCTS

CROSS-REFERENCE

This application is the U.S. National Stage of International Application No. PCT/EP2018/054228, filed 21 Feb. 2018, which claims priority to French Application No. FR1751525, filed 24 Feb. 2017.

FIELD OF THE DISCLOSURE

The present disclosure pertains to a container for storing medical and/or pharmaceutical products and a method of manufacturing this container. The present disclosure also pertains to a sealed package comprising this container.

TECHNICAL BACKGROUND

Document U.S. Pat. No. 8,875,917 B2 describes a container which receives bulk stored products such as pills or tablets, particularly effervescent tablets. One objective is to provide a closing cap for a container which has improved storage performance and can be manufactured in a cost-effective manner. The closing cap includes a lid portion connected by a hinge to a connecting element intended to fasten onto a container body. The lid portion includes a skirt that engages in a moisturetight manner into the opening of the container body and a drying chamber. The container body comprises a flange which serves to securely receive a ring connecting element of the closing cap. The ring element can be snapped onto the flange (positive fit). The cap comprises breakable tamper-evident links between the lid portion and the ring portion. When first used, the user must first break the tamper-evident decks to open the closing cap and access the products stored inside the container. Accordingly, if the tamper-evident links are intact, the consumer is sure that the container has not been opened.

The cap further comprises a drying housing to receive a desiccant, for example a silica gel, a calcium chloride, a molecular sieve, other drying agents or any mixture thereof. These active agents allow moisture to be removed from the interior of the container body to preserve the stored moisture-sensitive products. In fact, the moisture originates from the external environment and can, for example, enter the interior of the container when it is filled with the products to be stored, but also during its storage by permeation (diffusion) through the walls of the container, or via the seal between the container body and the cap, or during its use by the consumer through the repeated opening and closing of the container. The drying housing thus makes it possible to increase the shelf-life and storage time of the products contained in the container.

In this context, there is a need to provide an improved container for storing medical and/or pharmaceutical products sensitive to moisture and/or other gaseous substances, such as oxygen or volatile organic compounds. In particular, there is a need to provide an improved, reliable, easy to handle, economical container, avoiding leakage problems of desiccant or agents for treating the atmosphere inside the container, and allowing to absorb moisture and/or gaseous substances entering the container, even after a quick opening/closing cycle, while providing a tamper-evident indicator (first opening indicator).

SUMMARY OF THE DISCLOSURE

Therefore, a container for the packaging of sensitive products, such as medical and/or pharmaceutical products, as described in the claims is proposed. The container comprises a plastic container body. The container body includes a side wall, a base and an opening defining a storage volume. The container also includes an active insert within the container body.

The container also includes a flange configured to receive a connecting element of a cap comprising a tamper-evident mechanism. The cap can be hinged (hinged cap) or not. It is preferably hinged.

An assembly for the packaging of sensitive products, such as medical and/or pharmaceutical products, comprising the container assembled with a cap which includes a tamper-evident mechanism, preferably a hinged cap, is also proposed.

This container exhibits the safety characteristics of containers having a tamper-evident system, the said safety characteristics being particularly important in the industry of containers for the storage of medical and/or pharmaceutical products. In this context, the presence of an active insert mounted inside the container body makes it possible to use a less bulky and less heavy hinged cap, while ensuring better action on the environment of the products. This container is compatible with existing filling and assembling lines as used to package sensitive products in a container and requires little or no modification for the packaging of sensitive products or the assembly of the cap on the container body. With respect to the existing hinged caps comprising a desiccating chamber, the assembly of the container and of the hinged cap according to the present disclosure makes it possible to limit the obstruction of the access opening to the contents of the container and the cap is less inclined to falling, under the effect of its weight, on the container body.

The container can be provided not closed and does not require the preliminary stage for opening of the cap before filling the container and pack the products into the storage volume inside the container. Moreover, the container may comprise a tamper-evident mechanism (first opening indicator of the container).

The container may further comprise the cap assembled to the container body. The cap is preferably hinged, i.e. it is connected to the container body via a hinge. The container body and the cap are configured to form an air and moisture-tight seal between the container body and the cap.

The container may further comprise medical and/or pharmaceutical products stored within the storage volume. The container and/or the hinged cap may be configured to allow the products' distribution.

The active insert comprises an active material capable of acting on the atmosphere of the container's storage volume. In other words, the active material is capable of acting on gaseous substances present in the container's storage volume. The action makes it possible to maintain the quality of the sensitive products during their storage, for example maintaining the physical and/or chemical integrity as much as possible and/or as long as possible, in particular by protecting the products against gaseous substances likely to impair their integrity and/or their properties. The active insert is preferably formed of a material comprising a polymer and at least one active agent capable of trapping and/or releasing one or more gaseous substance(s), such as, for example, moisture, oxygen and/or a volatile organic compound.

Medical and/or pharmaceutical products may comprise any product having a medical and/or pharmaceutical function. This may include products such as test strips, medicines, dietary supplements, pills, tablets, capsules, tablets, granules and powders. The container and/or cap, preferably hinged, can be configured to meet the air-tightness and protective requirements for this medical and/or pharmaceutical function when the container is closed with the cap. Likewise, the plastic material of the container body may be compatible with such a medical and/or pharmaceutical function.

The container body may be of any shape. The container body may have a generally tubular shape. A tubular shape means a shape of a cylinder with a circular or non-circular base. For example, the base may be a disc, an oval, a square, a rectangle, a regular or non-regular polygon, or a combination of planar surfaces and/or curved surfaces. Moreover, the diameter and/or thickness of the tubular wall may vary at least partially along the length of the tubular wall of the container body.

In examples, the container may further comprise any combination of the following features:

The container body may have a generally tubular shape.

The container body is injection moulded.

The plastic material of the container body has a low permeability to moisture and/or oxygen, preferably to moisture. The plastics material may be chosen from polyolefins (polyethylene, polypropylene), polyesters, polycarbonate, cycloolefin, preferably polyolefin, in particular polypropylene and/or polyethylene.

The active insert comprises a generally tubular side wall.

The bottom end of the side wall of the active insert is closed with a base.

The active insert can be moulded directly with the container body, in particular by over moulding.

Alternatively, the active insert may be moulded separately from the container body and then inserted into the container body, for example by pushing the active insert into the container body or by mounting the container body on the active insert.

In the case where the active insert is moulded separately from the container body and then assembled within the container body, the active insert may be held by pressing or clamping at least a portion of its side wall on a peripheral portion of the inner surface of the side wall of the container body.

The active material includes at least one active agent.

The active agent is an agent capable of interacting with at least one gaseous substance such as moisture, oxygen, volatile organic compounds and/or odours. In particular, the active agent is an agent capable of trapping and/or releasing at least one gaseous substance such as moisture, oxygen, volatile organic compounds and/or odours. Preferably, the active agent is capable of trapping moisture and/or oxygen.

The active agent is a desiccant and/or an oxygen scavenger.

The desiccant is selected from silica gel, calcium oxide, clay, molecular sieve, zeolites, deliquescent salt (such as for example calcium chloride, magnesium sulfate, potassium acetate) or any combination thereof.

The oxygen scavenger is selected from iron-based oxygen scavengers, ascorbic acid, polymer-based oxygen scavengers, or any combination thereof.

The active material further includes a polymer in which the active agent is scattered. The polymer may be, for example, a thermosetting or a thermoplastic, preferably a thermoplastic polymer.

The polymer is preferably substantially permeable to the gaseous substance interacting with the active agent. It may be chosen as a function of its transmission rate for the gaseous substance under consideration.

The polymer is selected from polyolefin-based polymers, for example polyethylene, HDPE, LDPE, polypropylene (PP), polystyrene (PS), polyvinyl chloride (PVC), ethylene vinyl acetate (EVA), ethylene-vinyl acetate copolymer (EVOH), a cyclic olefin copolymer (COC); polymers based on polyesters, for example polycaprolactone (PCD), polylactic acid (PLA), polyethylene terephthalate (PET), polybutylene terephthalate (PBT), polycarbonate (PC), polyoxymethylene (POM), polyamide, PPS sulphuretted polyethylene, BOPP or cellulose.

The flange is peripheral and forms a fastening means placed on the outer surface of the side wall of the container body. It is configured to receive a cap, more particularly a connecting element of a cap.

The flange is preferably continuous, i.e. formed over an entire periphery of the container body; in another embodiment, the flange may be discontinuous.

The flange is located towards the upper end of the side wall of the container body near the opening of the container body. In other words, it is placed on a portion of the side wall of the container body which is adjacent to the opening of the container body.

The flange has a vertically measured thickness T1 at the junction point with the container body which is less than the horizontally measured thickness T2 of the side wall of the container body. Preferably T1≤⅔ T2, preferably T1≤½ T2.

The flange is reinforced by an array of ribs joining the flange to the outer surface of the side wall of the container body. These ribs are particularly useful for reinforcing the flange when its thickness is very reduced.

The flange has a horizontal portion extending from the side wall of the container body to the outside and is perpendicular to it. In other words, the horizontal portion (or section) extends radially outwardly from the side wall of the container body.

The flange further comprises a vertical portion extending vertically from the end of the horizontal portion of the flange. Preferably, the vertical portion (or section) extends perpendicularly to the horizontal portion. It can extend towards the opening of the container body (i.e. upwards when the container body rests on its base) or towards the base of the container body (downwards). Preferably the vertical portion extends downwardly.

The horizontal portion of the flange (or collar) includes a horizontal upper surface. This horizontal surface serves to support the connecting element of the cap (preferably hinged) and makes it possible to immobilise and vertically secure the cap on the flange while preventing the cap from sliding or disengaging from the flange, especially when a great force is applied to the cap, for example during the assembly phase of the cap on the container body. This configuration has an advantage over existing flanges that have an inclined upper surface on which the connecting element of the cap can more easily slide along this inclined surface (under the effect of a pressure), sometimes until passing below the flange. Another advantage is that, as the cap is better held vertically on the flange, the axis of rotation of the hinge of the cap is fixed and well defined. The precisely defined rotation of the cap during the opening and closing cycles allows a better positioning of the sealing means of the cap against the container body, and then a better quality of the seal in terms of air and moisture tightness.

The horizontal upper surface of the horizontal section includes, at its outer end, a rounded or chamfered portion. This makes the cap easier to assemble. Indeed, The assembly of the connecting element of the cap on the fastening means (or flange) of the container body is easier and requires less force. Furthermore, the radius makes it possible to guide and centre the cap around the flange during its assembly when the cap is not perfectly aligned with the container body on the assembly lines.

The flange has an angular cross-section, preferably at an angle of 90°. This angle is formed by the horizontal portion and the vertical portion of the flange.

The angular shape has a rounded upper surface; in other words, the horizontal upper surface of the horizontal portion has a rounded shape at its outer end from which the vertical section extends. Thus, the flange has a radius between the horizontal upper surface of the horizontal portion and the outer side surface of the vertical portion. The rounded upper surface allows an easier assembly of the cap on the flange of the container body, requiring a little less accuracy for the alignment of the connecting element of the cap with respect to the flange and less force to snap-fasten the connecting element onto the flange.

The angular shape has a chamfered upper surface. In other words, the angular shape has a chamfer between the horizontal upper surface of the horizontal portion and the outer side surface of the vertical portion. The chamfered upper surface also facilitates assembly of the connecting element of the cap onto the flange of the container body.

The angular shape has a right angle between the horizontal upper surface of the horizontal portion and the outer side surface of the vertical portion.

The thickness of the horizontal portion of the flange is smaller than the thickness of the vertical portion.

The thickness of the horizontal portion of the flange is smaller than the thickness of the side wall of the container body.

The ratio between the thickness of the horizontal portion of the flange and the thickness of the side wall of the container body in the area adjacent to the horizontal portion is less than or equal to 2/3, preferably 1/2. In other words, the thickness of the horizontal portion represents at most ⅔ of the thickness of the side wall of the container body, taken at its junction with the horizontal portion of the flange. This thickness makes it possible in particular to avoid shrinkage (deformations or hollows) on the internal surface of the side wall of the container body directly adjacent to the flange, and thus to guarantee a well-defined internal surface on this area, even using short cooling cycle times during the manufacturing process of the container body, for example by injection moulding.

The container further includes a cap, which is preferably hinged. The cap is moulded independently of the container body and assembled to the container body via the flange. This has the advantage in particular of being able to use different materials and/or colours for the cap and for the container body.

The cap includes a connecting element, preferably a ring connecting element, configured to be secured to the flange of the container body, a lid portion configured to close the opening of the container body in an airtight manner and a tamper-evident mechanism between the lid portion and the connecting element.

The tamper-evident mechanism can be any element allowing to indicate to the user that the container with its cap has never been opened. The tamper-evident mechanism is broken or removed when the cap is first opened. It can comprise one or several breakable link(s) (or breakable bridges) directly connecting the lid portion to the connecting element. Alternatively, it can comprise a tearable strip connected to the lid portion and to the connecting element (for example by means of breakable links between the tearable strip and the lid portion/the connecting element). The tearable strip can be provided with an extension to conveniently grip and remove the strip when opening the container for the first time. The tamper-evident mechanism gives a clear indication to the user once the closure has been opened for the first time.

The cap may be a tamper-evident cap without any hinge, which involves that the lid portion is no more attached to the container body when it is opened. This type of cap generally comprises a lid portion, a ring connecting element and a tamper-evident mechanism, such as for example a plurality of breakable links between the connecting element and the lid portion. During the first closure of the cap after filling the products into the storage volume, the ring connecting element snaps onto the flange of the container body. After the first opening, the lid portion is completely separated from the connecting element (the latter being retained onto the flange of the container body).

According to a preferred embodiment, the cap is a hinged cap (or cap with a hinge). Such a hinged cap comprises a hinge connecting the lid portion to the connecting element. In this way, even after the consumer first opened it, the lid portion remains attached to the container body during the opening and closing cycles of the container. A hinged and tamper-evident cap comprising a ring connecting element is described, for example, in U.S. Pat. No. 8,875,917 B2.

The cap, preferably hinged, is configured to cooperate with the side wall of the container body so as to form an airtight seal. This allows better protection of sensitive products to be stored.

The cap is made of plastic. The plastic material may be the same or different from that of the container body. Preferably, the plastic material is different from that of the container body. For example, it may be advantageous to use a (slightly) more flexible material for the cap than that of the container body.

The cap is injection moulded.

The plastic material of the cap has a low permeability to moisture and/or oxygen, preferably to moisture. The plastic material may be chosen from polyolefins (polyethylene, polypropylene), polyesters, polycarbonate, cycloolefin, preferably polyolefin, in particular polypropylene and/or polyethylene.

The cap can be made of a single material or two different materials. The latter allows to combine the barrier properties of the materials with different gases (an oxygen barrier material combined with a moisture barrier material for example) or to combine the barrier properties of a first material with the elastic properties of a second material (to form the hinge and/or to form a flexible seal).

The cap is moulded in one piece. When the cap is hinged, it is preferably moulded in the closed position.

The lid portion has a sealing surface configured to cooperate with a sealing surface on the container body so as to form an airtight seal between the cap and the container body when the cap is in the closed position.

The lid portion comprises a sealing skirt. The sealing skirt is configured to cooperate with the container body so as to form an airtight seal. In other words, the sealing surface of the lid portion is located on this sealing skirt. Preferably, the sealing skirt comprises a bulge on its lower part. The sealing skirt extends in a direction that is substantially perpendicular to the top wall of the lid portion from the inner side of the lid portion. It preferably comprises a bulge located towards the lower end of the sealing skirt (the free end of the skirt opposite to the end by which the skirt is attached to the inner side of the top wall of the lid portion). The bulge is directed towards the side wall of the container body. The bulge formed on the sealing skirt of the lid portion may thus constitute the sealing surface of the cap which cooperates with the side wall of the container body so as to form an airtight seal when the cap is in position closed.

Preferably the sealing skirt of the lid portion which cooperates with the side wall of the container body forms the only sealing surface between the cap and the container body.

The sealing surface of the container body is located on the side wall of the container body, preferably on the inner surface of the side wall of the container body. The sealing surface of the container body may be located on a flat portion of the inner surface of the side wall of the container body or may be located in a peripheral groove and/or peripheral bulge formed on the inner surface of the side wall of the container body.

The sealing surface of the container body configured to cooperate with the sealing surface of the cap is in a peripheral cavity on the inner surface of the side wall of the container body.

The radius of the peripheral cavity is greater than the radius of the bulge on the sealing skirt.

The sealing surface of the container body is preferably not axially adjacent to the peripheral flange (not vertically aligned).

The connecting element of the cap, preferably hinged, is configured to be snapped (i.e. to form a positive engagement) on the flange.

The connecting element of the cap comprises, on its internal surface, a recess configured to cooperate with the flange of the container body.

The connecting element of the cap, preferably hinged, is a ring element.

The connecting element of the cap comprises on its inner surface a vertical cylindrical surface S5 which cooperates with the outer surface S4 of the vertical portion of the flange once the cap is assembled on the container body. Preferably, before the cap is assembled to the container body, the diameter of the vertical cylindrical surface S5 of the connecting element is equal to or smaller than, more preferably smaller than, the outside diameter of the vertical portion of the flange.

The connecting element of the cap is made of a resilient material which allows its diametrical extension after assembly on the container body. In this way, and after assembly of the cap on the container body, the connecting element of the cap exerts pressure on the flange, thus limiting the rotation of the cap around the flange of the container body, particularly when the cap is opened.

The cap, preferably hinged, further comprises a tamper-evident mechanism

The tamper-evident mechanism comprises at least one breakable link connecting the lid portion to the connecting element, preferably a plurality of breakable links.

The tamper-evident mechanism comprises a tearable strip connecting the lid portion to the connecting element.

The tamper-evident mechanism is broken when the cap is first opened.

The cap, preferably hinged, does not comprise a drying chamber and/or an active agent.

The cap, preferably hinged, comprises an opening means with a grip portion and/or a cavity in the lid portion.

The cap, preferably hinged, has a total height of less than 15 mm, preferably less than 12 mm.

The cap, preferably hinged, has a total weight of less than 3 g.

When the cap closes the opening of the container body, the container has a moisture penetration rate W of less than 1 mg/day at 40° C. and 75% relative humidity (rH), established according to the standard method ASTM D7709-12, preferably less than 0.7 mg/day, more preferably less than 0.5 mg/day.

The degree of penetration of moisture depends in particular on the length of the seal between the cap and the container body. When the cap closes the opening of the container body, the container has a moisture penetration rate W of less than 10 μg/day/mm of seal length, preferably less than 7 μg/day/mm of the sealing surface's length at 40° C. and 75% relative humidity (rH). In other words, for a circular container with a seal of 25 mm diameter, the container has a moisture penetration rate of less than 785 μg/day at 40° C. and 75% rH.

The moisture penetration rate depends also on the dimensions and construction materials of the container. Considering:

"W" is the moisture penetration rate of the container plugged with its cap and set at 40° C., 75% rH according to the standard method ASTM D7709-12, "S" is the total external surface area of the container in $m^2$, "e" is the average thickness of the container in mm, the permeability to moisture of the container closed by its cap $P=W \cdot e/S$ is less than 220 $mg \cdot mm/m^2 \cdot day$, preferably less than 160 $mg \cdot mm/m^2 \cdot day$, preferably less than 120 $mg \cdot mm/m^2 \cdot day$ at 40° C., 75% rH.

The disclosure also relates to a sealed package comprising at least one container according to the disclosure, wherein the sealed package is substantially impermeable to gas, preferably to moisture and/or oxygen. At least one container (preferably at least two containers) is (are) sealed within the package and opened (e.g. without a cap). The sealed package can for example be a sealed aluminium bag. Indeed, the container can be provided opened before it is filled with medical and/or pharmaceutical products. One or several containers can be stored and/or transported in a same sealed package. In this manner, the absorbing properties of the active insert can be preserved until the container is filled with the medical and/or pharmaceutical products and then closed with a cap.

The package is made preferably of a flexible material substantially impermeable to moisture.

Preferably, the package is made of a material having a moisture vapour transmission rate of less than 3 g/m2/24 hrs, more preferably less than 0.3 g/m2/24 hrs, measured at 38° C. and 90% RH according to the standard method ASTM E96. Examples of materials are film materials comprising at least one layer of polymer and/or of aluminium. The polymer is preferably selected from polyolefin and polyester. More preferably, the material of the package has a moisture vapour transmission rate of less than 0.1 g/m2/day at 38° C., 90% RH.

The package is preferably airtight sealed. For example, if the package is an aluminium bag, it can be sealed by applying heat and/or pressure, and, optionally, using a sealant or an adhesive layer.

The sealed package can further contain an active agent capable of interacting with one or more gaseous substance(s) among moisture, oxygen and/or a volatile organic compound. The active agent can be capable of trapping moisture and/or oxygen. Alternatively, the active agent can be able to release moisture. The active agent can be contained in a canister or in a packet. Alternatively, it can be integrated in a molded object made of a composition comprising the active agent and at least one polymer, for example a thermosetting polymer or a thermoplastic polymer. Then, the canister, the packet and/or the molded object containing the active agent can be included within the package.

The sealed package can further contain a substance able to release moisture inside the sealed package, preferably a substance able to release a given amount of moisture inside the sealed package. The substance can be able to release moisture once it is placed within the package. An advantage to combine, in a sealed package, the container of the present disclosure with a moisture releasing substance is that, during storage of the container of the disclosure, the substance can hydrate the active insert of the container until an equilibrium is reached inside the package. It can be advantageous when the container is intended to store medical and/or pharmaceutical products that need to be stored in an environment that is not completely dry or that is maintained at a certain level of relative humidity (such as for example gelatin coated capsules). This optimal level of relative humidity for preservation of the sensitive products depends on these medical and/or pharmaceutical products and can be between 2% and 80% rH, preferably between 5 and 60% rH. As an example of application, depending on the active material of the active insert and the level at which it is hydrated, the active insert could, once the container is filled with the sensitive products and closed, equilibrate the storage volume and its content (the sensitive products) at a substantially constant relative humidity, said level of relative humidity being between the water activity of the active insert (hydrated at a specific level) and the water activity of the sensitive products, expressed in percentage.

More preferably, the substance is able to equilibrate the relative humidity inside the package at a substantially constant level of at least 2% rH at 20° C., more preferably at least 5% rH at 20° C.

The substance can be water, for example, a given amount of water. The substance can also be a saturated salt solution. A desired relative humidity inside the package can be achieved by selecting the appropriate salt. The substance (water or saturated salt solution) can be contained in a housing (for example a container or canister or a pouch) that is impervious to liquid and permeable to moisture. This housing can then be added within the package.

Alternatively, the substance can be a hydrated active agent capable of releasing moisture. Examples of such agents are silica gel, clay, deliquescent salt or a mixture thereof.

The substance is preferably a hydrated active agent selected from silica gel, bentonite clay, montmorillonite clay or any combination thereof. Such agents can be fully hydrated (at saturation). Alternatively, such agents can be hydrated with a given amount of water. Depending on their level of hydration, these agents are able to equilibrate the relative humidity inside the package at a substantially constant level. Hydration of such agents at a predetermined level is for example described in EP 2277799.

The substance can be under the form of powder or granulates. It can be contained in a canister or a packet that is permeable to moisture. Alternatively, the substance can be integrated in a molded object made of a composition comprising the substance and at least one polymer, for example a thermosetting polymer or a thermoplastic polymer. The molded object can be of any shape, for example a tablet, a sphere, a wafer, or under the shape of pellets of the compound. Then, the canister, the packet and/or the molded object containing the moisture releasing substance can be included within the package.

The disclosure also relates to a method for manufacturing the container. The method comprises the manufacture of a container body as described in the claims, in particular by thermoplastic injection moulding. The method also includes moulding an active insert, especially by thermoplastic injection moulding, and assembling it within the container body.

The active insert can be assembled in the container body by any assembly technique known as the state of the art, such as, for example, a clamping and friction retention, a snap-fit, a welding or a bonding.

Alternatively, the container may be obtained by over moulding, for example the container body may be over moulded around an active insert injected beforehand or vice versa by any known techniques of the plastics industry, such as moulding over the insert, bi-injection, co-moulding, bi-component injection.

The disclosure also relates to the use of such a container for the storage and/or packaging of medical and/or pharmaceutical products. Among the sensitive products, for example medication, such as effervescent or non-effervescent tablets, capsules, granules, powders, food supplements such as vitamins or minerals, but also diagnostic strips.

The disclosure also relates to a method for filling this container with medical and/or pharmaceutical products. The method includes:

- supplying a container comprising an active insert inside a container body equipped with a flange configured to receive a connecting element of a cap, preferably hinged,
- filling the container body with medical and/or pharmaceutical products, and
- assembling a cap, preferably hinged, provided with a tamper-evident mechanism, on the container body, preferably by applying a vertical pressure to the cap.

The assembly is achieved by snap-fastening the connecting element of the cap to the flange of the container body.

The method does not require a stage for opening the cap before filling the container body with the products. Indeed, the container can be provided opened, that is to say without the cap.

The container body can be conveyed on conventional filling lines designed for snap-fastening of a cap on the container body: after the products have been filled in the container body equipped with its active insert, the container body is conveyed to an assembly station where a cap supply line deposits the cap on the opening of the container body and where a vertical pressure is applied to snap and secure the cap onto the flange of the container body.

Another object of the disclosure relates to a container for packaging medical and/or pharmaceutical products, wherein the container comprises:

- a plastic container body comprising a side wall, a base and an opening defining a storage volume, and
- a flange formed on the container body and configured to receive a connecting element of a cap, preferably hinged, equipped with a tamper-evident mechanism.

This container may also have an active insert and/or any combination of the characteristics mentioned above.

In particular, the flange has preferably a horizontal portion extending outward from the side wall of the container body and substantially perpendicular to said side wall of the container body. A container body with such advantageous flange can better maintain and attach the connecting element of the cap, avoiding any little vertical movement of the connecting element regarding the container body. Compared to flanges having an inclined upper surface, it allows to decrease the risks of sliding or disengagement of the connecting element from the flange, for example when a vertical pressure is applied to the cap. A further advantage of the horizontal portion of the flange when the cap is hinged is that, due to the vertical immobilisation of the connecting element of the cap (with horizontal upper and lower surfaces of the flange), the axis of rotation of the hinge remains also vertically immobilised and the hinged cap pivot along a well-defined axis of rotation, which allows the sealing surfaces of the cap to be accurately positioned regarding the walls of the container body and then a better airtightness between the cap and the container body.

Preferably, the thickness of the horizontal portion of the flange is smaller than the thickness of the side wall of the container body, taken on the area adjacent to the horizontal portion. More preferably, the ratio between the thickness of the horizontal portion of the flange and the thickness of the side wall of the container body, taken on the area adjacent to the horizontal portion, is less than or equal to 2/3. Such advantageous ratio allows to avoid defects and shrink mark on the internal surface of the side wall of the container body, facing the flange on the opposite surface of the side wall of the container. For example, such defects could be detrimental for the airtightness of the seal between the cap and the internal side of the container body.

DETAILED DESCRIPTION OF THE DISCLOSURE

Figure 1:
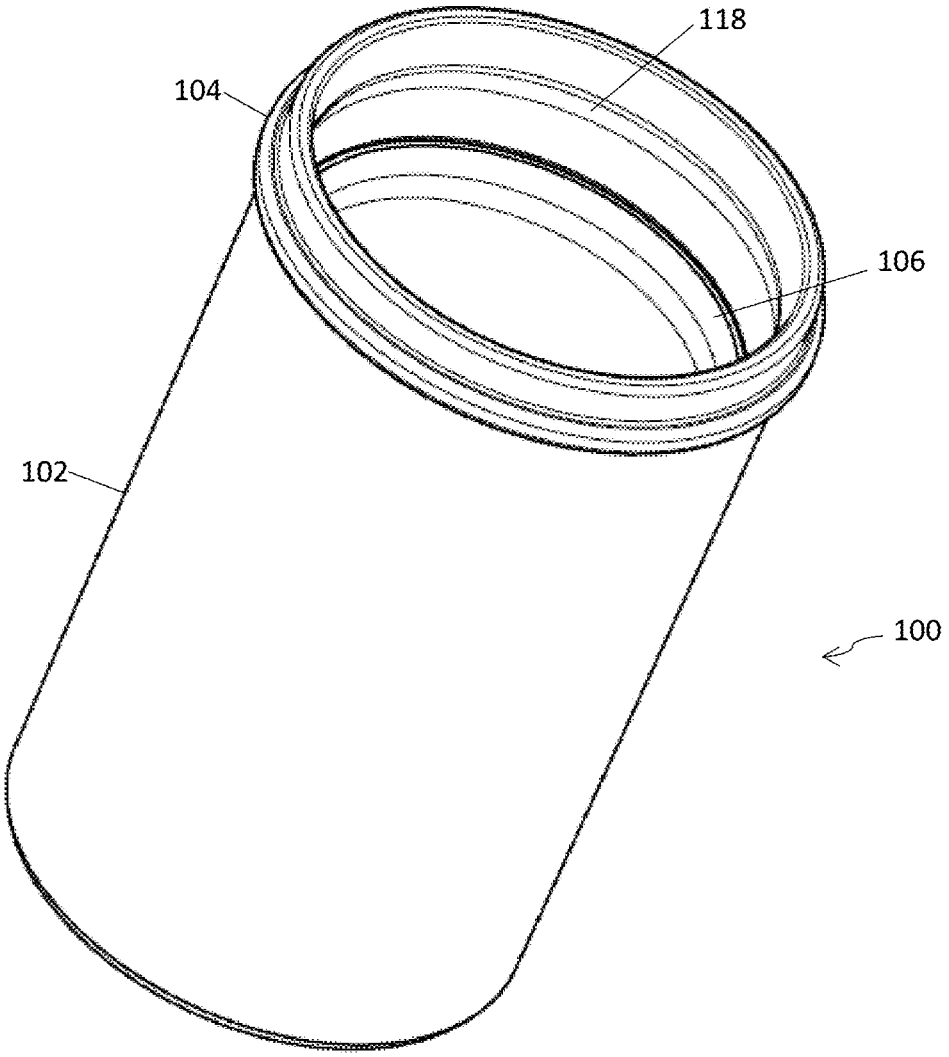
FIGS. 1-2 respectively show a perspective view and a cross-sectional view of an example of a container according to the disclosure.

The references below are used in the figures:

100 container (without cap)
102 container body
103 horizontal portion of the flange 104
104 flange or collar
105 vertical part of flange 104
106 active insert
107 flared upper part of the active insert 106
108 storage volume
109 outer surface of the active insert 106
118 peripheral cavity on the inner surface of the container body 102
150 of the junction area between the flange 104 and the side wall 202 of the container body
202 side wall of the container body 102
204 base of the container body 102
206 opening of the container body 102
300 container (with cap) moisture-proof
310 hinged cap
312 connecting element
314 lid portion
315 sealing skirt
318 bulge of the sealing skirt 315
321 protrusion on the inner surface of the connecting element
323 protrusion on the inner surface of the connecting element
325 recess on the inner surface of the connecting element
412 hinge (connecting the lid portion 314 to the ring element 312)
414 tamper-evident mechanism
512 grip portion (opening means)
514 cavity portion (opening means)
602 side wall of the active insert
604 base of the active insert
700 container
702 container body
703 horizontal section of flange 704
704 flange
706 active insert
800 container
802 container body
803 horizontal portion of flange 804
804 flange
806 active insert
900 sealed package
902 moisture realising substance
904 packet containing the moisture releasing substance 902
906 canister containing the moisture releasing substance 902
908 molded object containing the moisture releasing substance 902
S1 outer surface of the side wall 202 of the container body 102
S2 inner surface of the side wall 202 of the container body 102
S3 horizontal upper surface of the horizontal portion 103
S4 outer side surface of the vertical part
S5 inner surface of the connecting element of the cap
T1 thickness of the horizontal part 103 of the flange 104
T2 thickness of the side wall 202 of the container body 102

Figure 2:
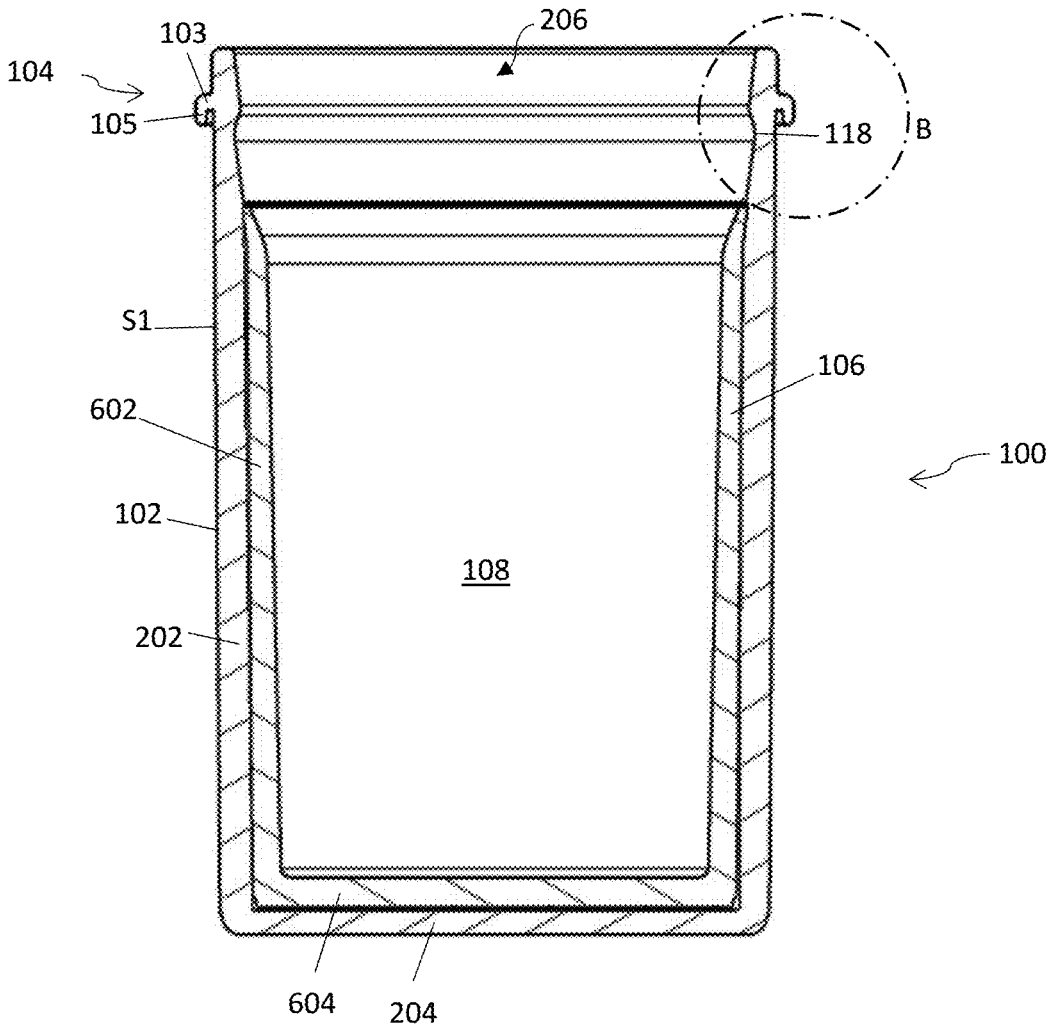
Figure 3:
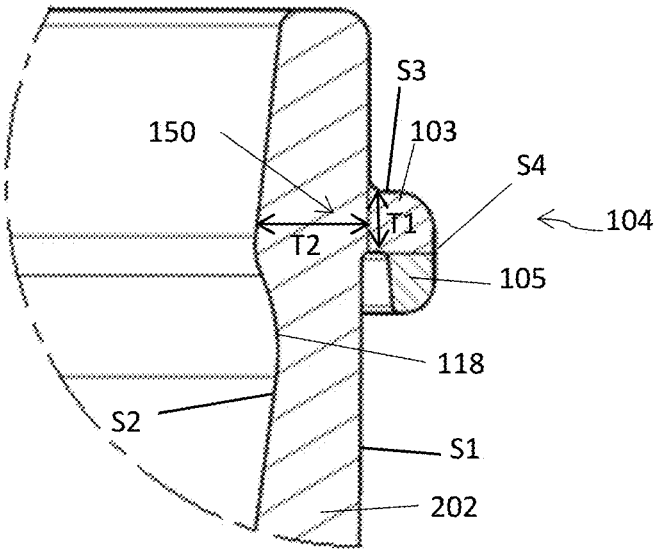
FIG. 3 shows an enlarged cross-sectional view of area B of FIG. 2.

The FIGS. 1-3 show a container 100 without a cap. The container 100 includes a plastic container body 102 with a storage volume 108, a flange 104 formed on the container body 102, and an active insert 106 mounted inside the container body 102.

Figure 4:
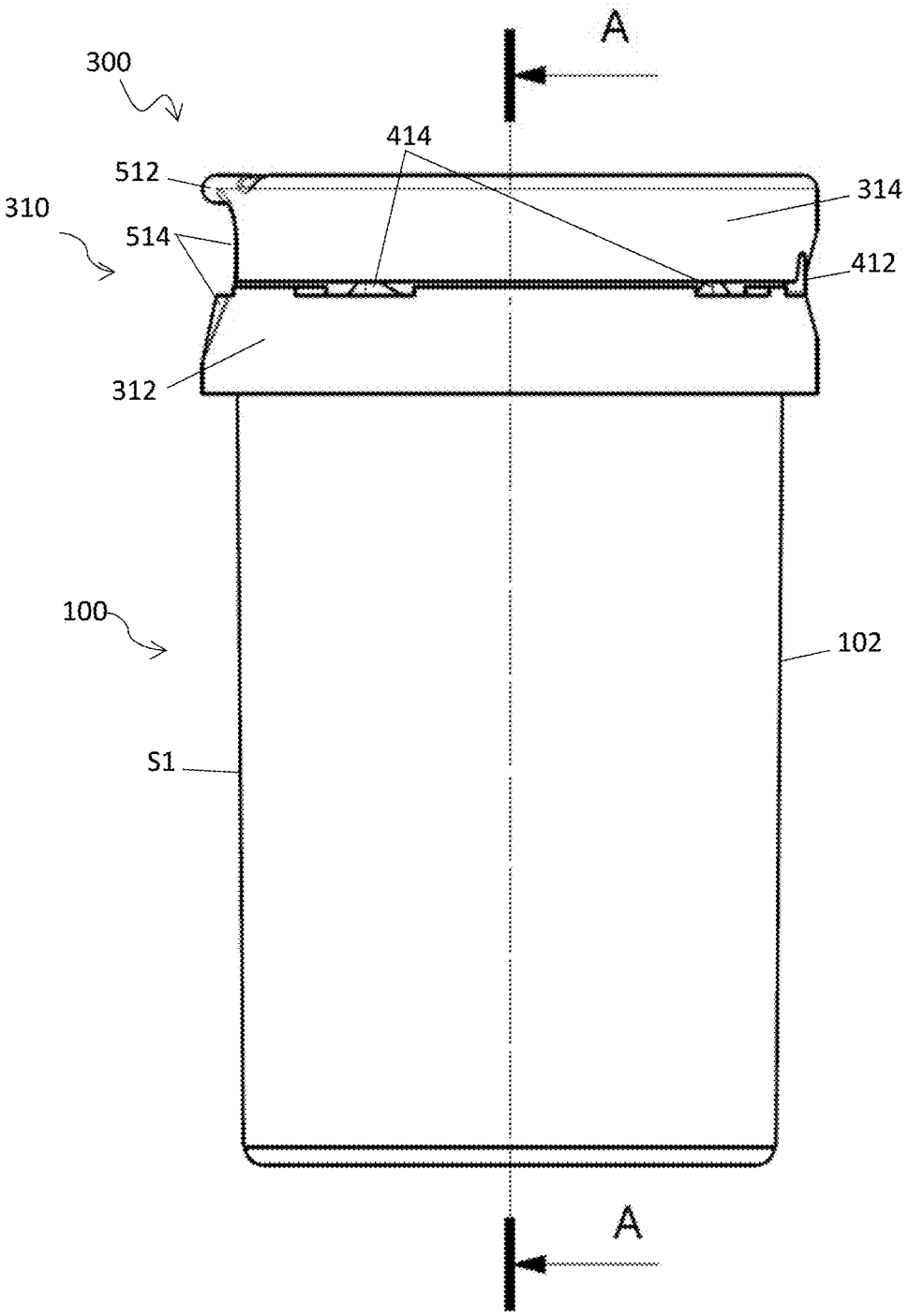
FIGS. 4-5 show profile and front views of the container equipped with a hinged cap.
Figure 5:
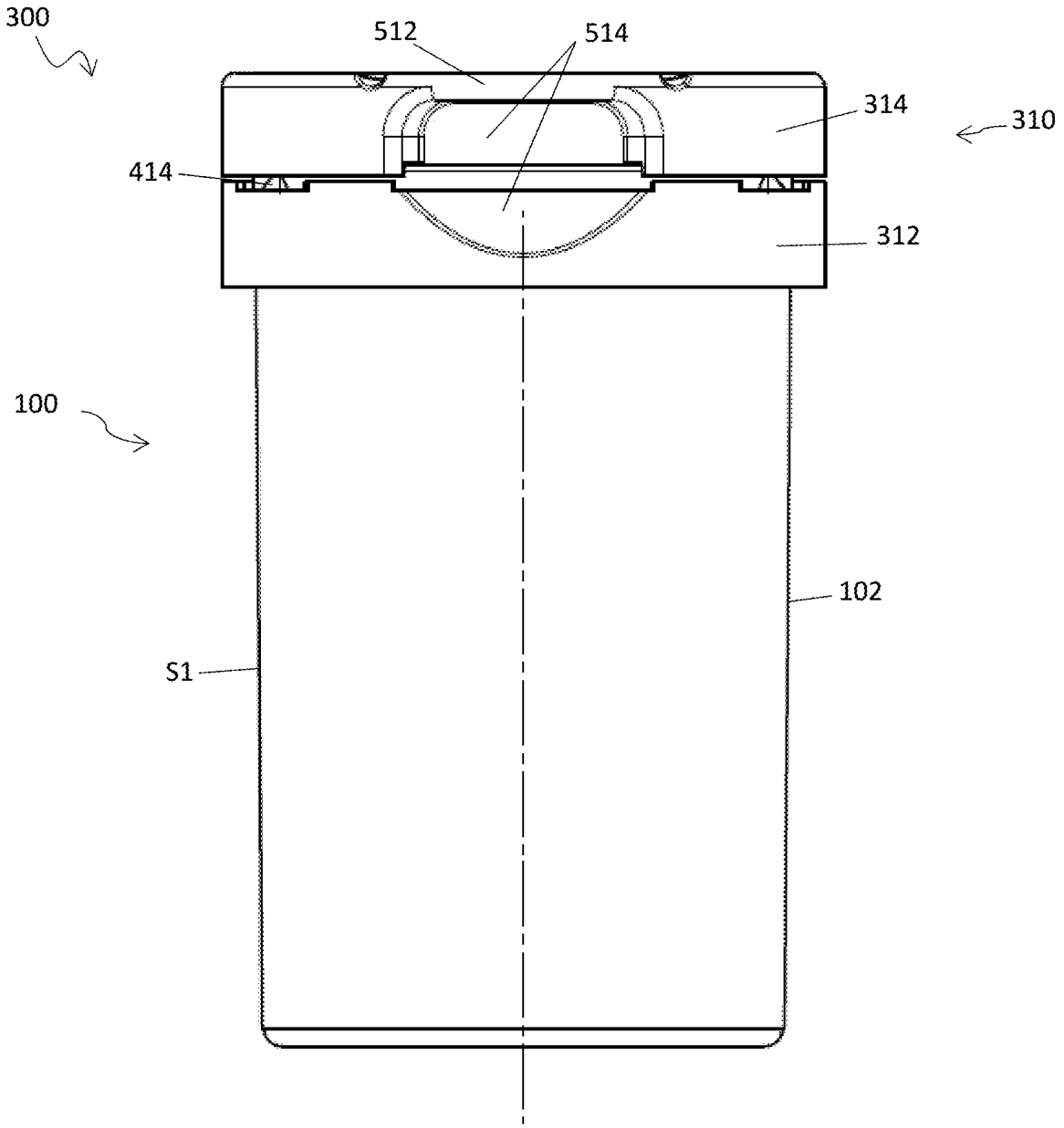
Figure 6:
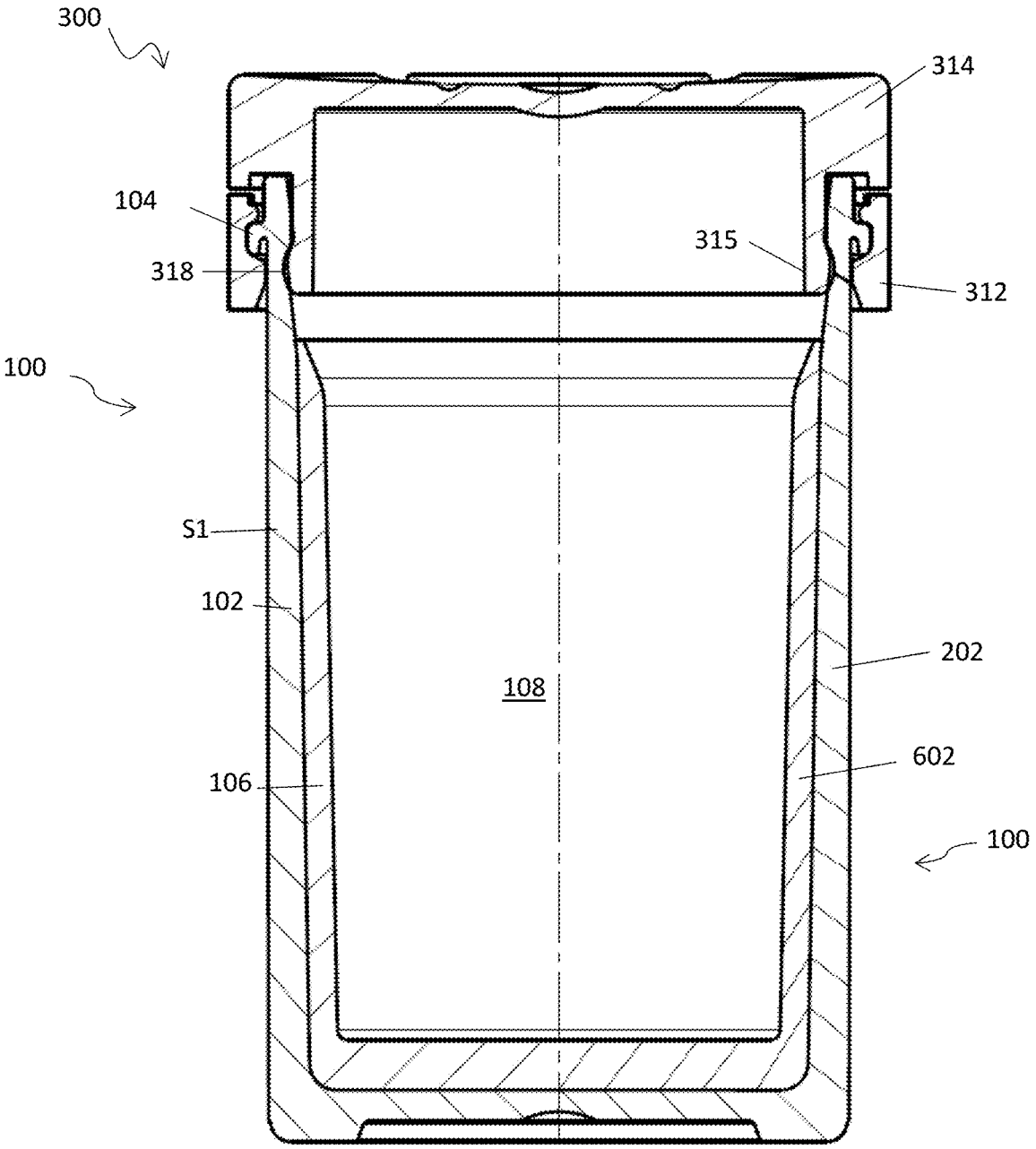
FIG. 6 shows a cross-sectional view along plane A-A of FIG. 4.

The FIGS. 4-6 show a container 300 consisting of the container 100 of FIGS. 1 to 3 and a hinged cap 310 assembled to the container body 102. The hinged cap 310 includes a ring connecting element 312, which is attached to the flange 104, a lid portion 314, and a 412 hinge 412 connecting the lid portion 314 to the ring element 312.

The container can be obtained by moulding the container body 102, preferably by injection, then for example by assembling the active insert 106 inside the container body 102. The active insert 106 may be mounted within the container body 102 for example by pushing down the active insert 106 into the container body 102.

The process can then be followed by filling the container 100 with medical and/or pharmaceutical products. The filling may include inserting the medical and/or pharmaceutical products into the container 100 and joining the hinged cap 310 to the container body 102 so as to obtain a moisture-proof container 300. The assembly can be carried out by conveying a cap over a container body and then applying a downward vertical force to the cap so that the ring connecting means of the cap snaps onto the flange of the container body.

The presence of the active insert 106 inside the container body 102 makes it possible to use a hinged cap which presents a smaller bulk and a lower weight than the hinged caps provided with a drying chamber. In particular, the hinged cap 310 does not contain any drying chamber and/or any active agent.

The presence of the active insert 106 within the container body 102 also reduces the risk of leakage of the active agent compared to the solutions of the prior design where a cap comprising a chamber filled with dehydrating agent is used. Indeed, the drying chambers of the prior design are generally closed by a cardboard disc which can be loosely fixed (for example defects can occur during fastening by crimping the end of the drying chamber), which can move from its original location or which can be damaged during the handling of the cap, especially when dispensing in bulk on packaging lines, during transport or during handling by the consumer.

In addition, the active insert 106 is mounted inside the container body 102 and is therefore closer to the sensitive products stored in the container 100, compared to the existing containers where the active agent is located in a drying chamber of the cap. In the figures, the active insert 106 surrounds the said products. In other words, the active insert defines at least a portion of the storage volume. This proximity improves the active function.

Referring to FIG. 1, the container body 102 has a generally cylindrical shape and the flange 104 is peripheral and continuous. The flange 104 is formed over the entire periphery of the container body 102. This allows a simple manufacture and an effective holding of the cap when assembled on the flange.

Referring to FIG. 2-3, the 102 container body comprises a side wall 202, a base 204 and an opening 206 defining a storage volume 108.

The container body 102 is further provided with a flange 104 which includes a horizontal portion 103 which extends perpendicularly from the outer surface S1 of the side wall 202 of the container body 102. Portion 103 forms a ring on the container body 102. The portion 103 comprises a horizontal upper surface S3. This surface S3 prevents the risk of downward displacement of the ring connecting element 312 of the hinged cap 310.

Indeed, on the flanges of the prior art, comprising an inclined upper surface, the ring connecting element could slide or even disengage from the flange when a strong vertical pressure was applied to the hinged cap 310. The hinged cap thus has the advantage of being firmly attached to the flange.

Moreover, the cap being well maintained on the flange, the axis of rotation of the hinge 412 remains fixed and well defined. The hinged cap can therefore pivot along a fixed and well-defined axis of rotation, which allows the sealing surfaces to be correctly positioned and to complement one another when the hinged cap 310 is closed and thus guarantees a good airtightness between the cap and the container body.

The flange 104 further comprises a vertical portion 105 which extends vertically and downwardly from the periphery of the horizontal portion 103. The portion 105 forms a cylinder around the container body 102. Thus, the flange 104 has a cross-section in the form of an angle, the angle here being 90°. This angular shape allows a particularly good holding of the hinged cap 310 on the flange.

In the figures, the angular or bent shape of the cross-section of the flange 104 is rounded. In other words, the outer edges of the angular shape meet gently and a radius is present between the upper surface of the horizontal portion 103 and the outer surface of the vertical portion 105. This also makes it easier to snap, the hinged cap 310 being guided and well recentred around the flange 104 when it is assembled on the container body 102 and to decrease the downward pressures necessary for the assembly of the hinged cap 310 on the container body 102.

Other embodiments are also possible. For example, the angular shape of the cross-section of the flange 104 may be chamfered or may form a right angle. In the second case, this makes it possible to increase the horizontal upper surface of the horizontal portion 103 and thus to further improve the stability or holding of the hinged cap on the flange.

The horizontal portion 103 has a thickness T1 less than that of the side wall 202 of the container body 102 on the area adjacent to the flange. This means that the thickness T1 of the horizontal portion 103 is smaller than the thickness T2 of the side wall 202 of the container body 102 at the place where the flange 104 is formed on the side wall 202. More particularly, as illustrated in the figures, the T1/T2 ratio is less than or equal to 2/3 and preferably less than 1/2. This range of relative values makes it possible to reduce the risk of shrinkage (or surface defects due to an accumulation area 150 of plastic material at the junction of the flange on the side wall and to the shrinkage of this material during cooling) while having a sufficiently resistant flange 104. Such a relative thickness of the horizontal portion 103 thus allows a better quality of the internal surface of the container body 102 which can have a decisive impact on the quality of the airtightness of the container.

Figure 7:
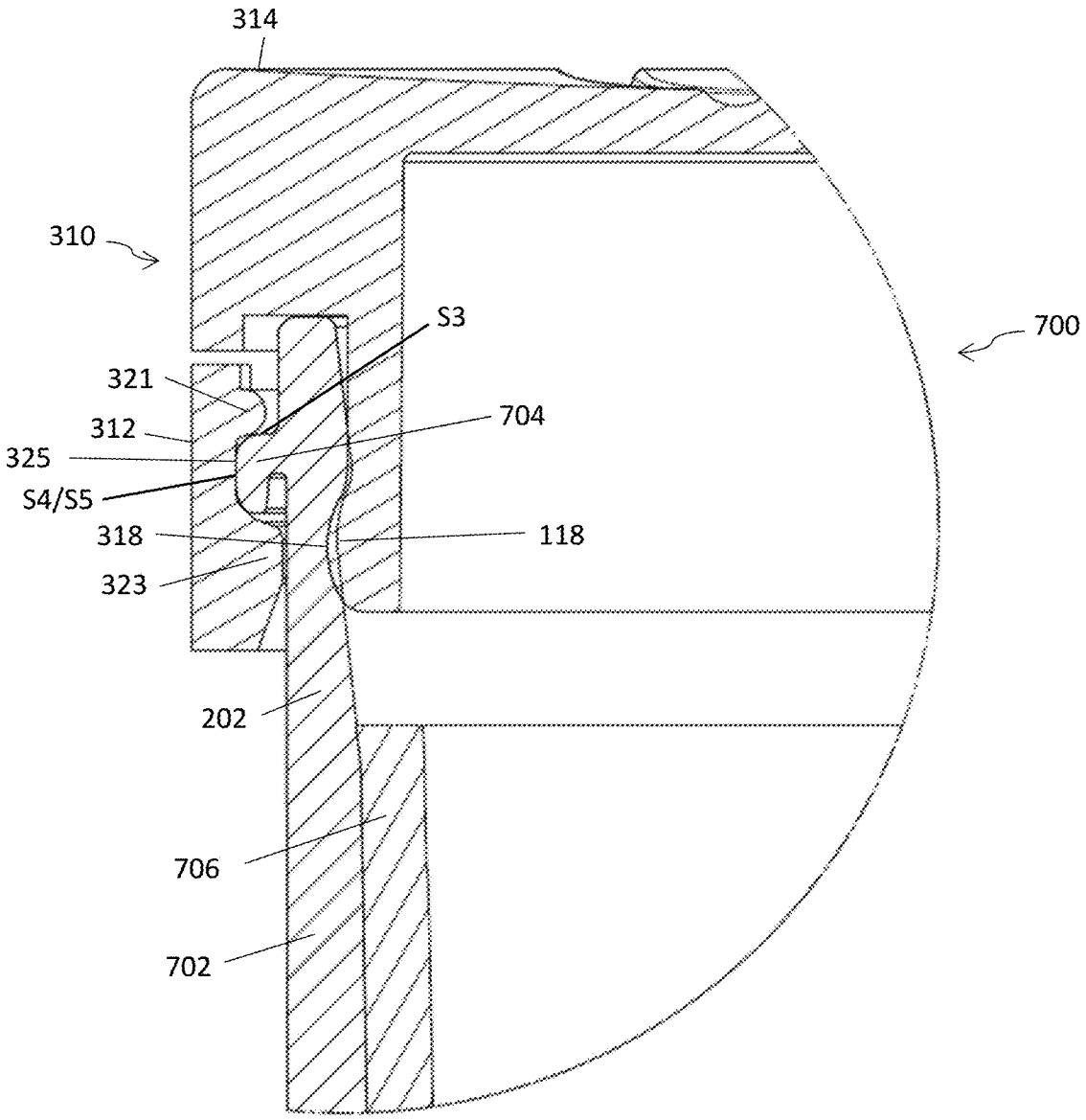
FIG. 7 shows an enlarged cross-sectional view of the container according to another embodiment, comprising a cap.
Figure 8:
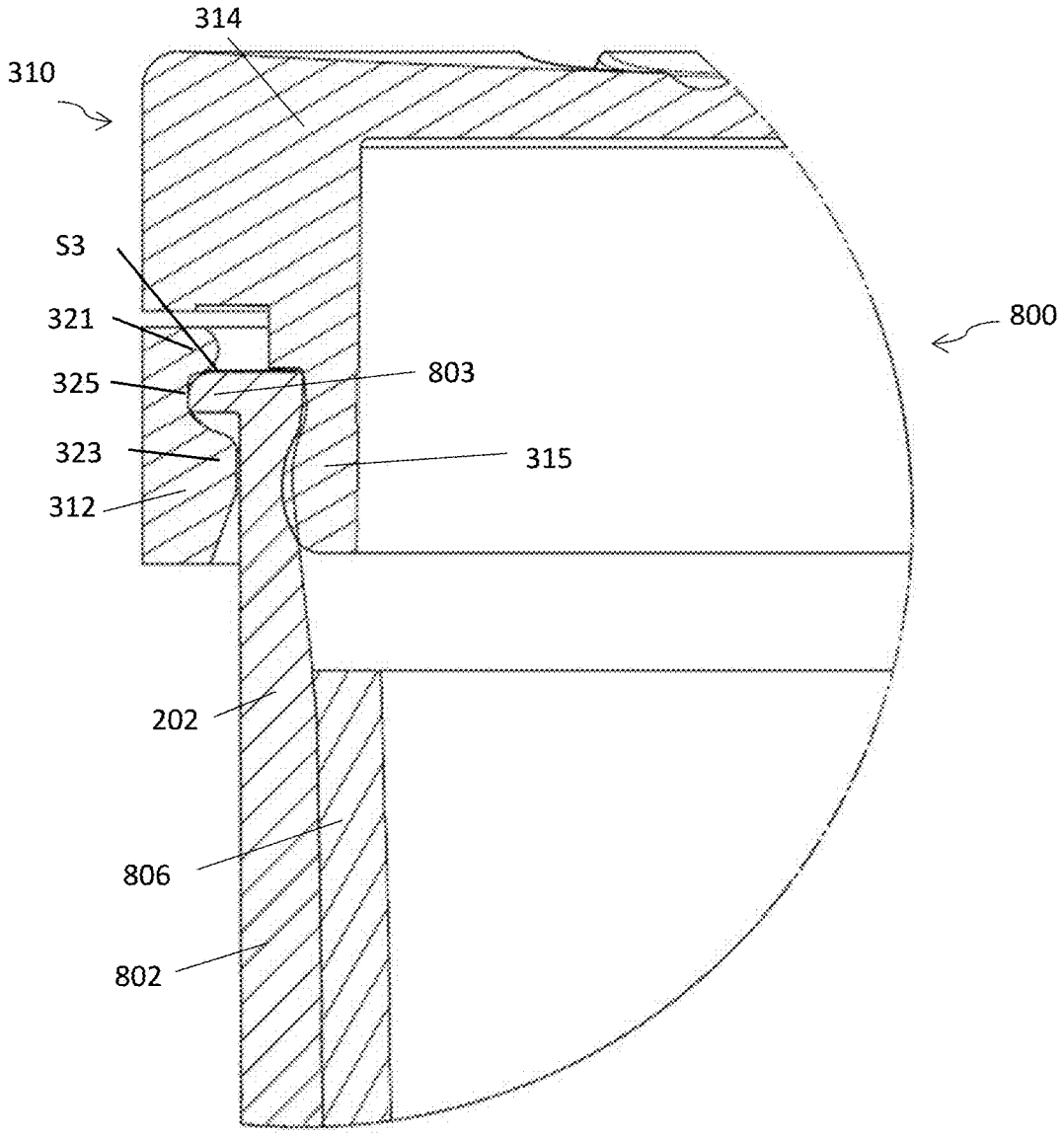
FIG. 8 shows an enlarged cross-sectional view of the container according to another mode with another example of a flange.

Referring to FIGS. 6 to 8, the lid portion 314 comprises a sealing skirt 315 which has a bulge 318. Furthermore, the inner surface of the container body 102 comprises a peripheral cavity 118. When the cap closes the opening of the container body, the bulge 318 formed on the sealing skirt 315 cooperates with the peripheral cavity 118 of the side wall 202 of the container body 102 so as to form an airtight seal. In this way, the storage volume 108 is insulated from the atmosphere outside the container.

The inner surface S2 of the side wall 202 of the container body 102 is configured to hold the active insert 106 within the container body 102. For example, the active insert may be held by clamping (tightening).

In FIG. 7, the container 700 includes a container body 702 and an active insert 706. The connecting element of the cap includes, on its inner surface, protrusions 321 and 323 intended to receive and secure the flange 704 of the container body 702. The connecting element of the cap comprises, on its internal surface, a recess 325 (formed between the protrusions 321 and 323) intended to cooperate with the flange of the container body. The cap 310 further includes a sealing skirt comprising a bulge 318 which cooperates with a peripheral cavity 118 on the inner surface of the side wall 202 of the container body 702.

The connecting element of the cap comprises on its inner surface a vertical cylindrical surface S5 which cooperates with the surface S4 of the vertical portion of the flange once the cap is assembled on the container body. Preferably the diameter of the vertical cylindrical surface S5 of the connecting element is smaller than the outer diameter of the vertical portion of the flange before the cap is assembled to the container body. The connecting element of the cap is made of a resilient material which allows the diameter of the vertical cylindrical wall of the connecting element to be enlarged during assembly on the container body. In this way, and after assembly of the cap on the container body, the connecting element of the cap exerts pressure on the vertical surface S4 of the flange, limiting the rotation of the cap around the container body, particularly in the case of an opened cap.

FIG. 8 shows a container body 802 in which the flange only has a horizontal portion 803. This horizontal portion 803 is located at the upper end of the side wall of the container body but may be located on another portion of the side wall near the opening of the container body. The horizontal part 803 comprises a horizontal upper surface S3 which is rounded at its outer end in order to facilitate the assembly of the cap on the flange.

Referring to FIGS. 4-6, the hinged cap 310 includes a tamper-evident mechanism comprising breakable links (or bridges) 414 connecting the lid portion 314 to the ring connecting element 312. The breakable links 414 are broken at the first opening of the hinged cap 310, which is then visible to the consumer.

The hinged cap 310 is also provided with an opening means comprising a gripping portion 512 formed in the lid portion 314 and a cavity portion 514 formed in the lid portion 314 and/or the ring element 312. Such an opening means is ergonomic. Such a cap may for example be injection moulded using slide moulds.

Figure 9:
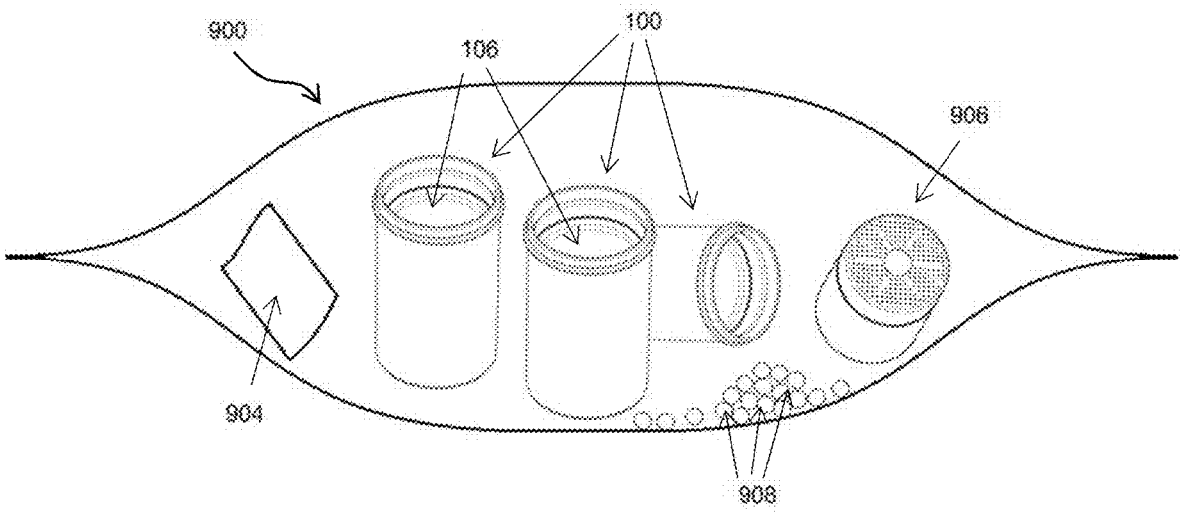
FIG. 9 represents a sealed package comprising at least one container according to the disclosure.

FIG. 9 shows a sealed package 900, comprising a plurality of containers 100 according to the disclosure. The sealed package 900 can be for example a sealed pouch whose walls comprise an aluminium layer. The package 900 is airtight sealed and is substantially impermeable to gas, and in particular, to moisture and oxygen.

The package further comprises an active agent, more particularly a moisture releasing substance 902 (not shown) able to release moisture inside the package 900. The moisture releasing substance 902 can be water and/or a hydrated active agent, such as for example silica gel, clay, deliquescent salt or a mixture thereof.

The moisture releasing substance can be contained in a packet 904 that is permeable to moisture, in a canister 906 that is permeable to moisture and/or in the polymer material of a molded object 908. Indeed, the molded object 908 can be made of an active material comprising the moisture releasing substance retained in a polymer matrix, for example a thermosetting polymer or a thermoplastic polymer. The molded object 908 can be of any shape, for example a tablet, a sphere, a wafer, or, as illustrated in FIG. 9, under the shape of pellets of the compound comprising the substance and the polymer.

The invention claimed is:

1. A container for packaging medical or pharmaceutical products, the container comprising:

a plastic container body comprising a side wall, a base and an opening defining a storage volume;

a cap comprising a lid portion configured to close the opening of the container body, a connecting element and a tamper-evident mechanism between the lid portion and the connecting element;

a flange formed on an outer periphery of the container body, the flange being configured to receive the connecting element of the cap and to vertically secure the cap thereon, wherein, before the cap is assembled to the container body, a diameter of a vertical cylindrical wall of the connecting element is smaller than an outside diameter of a vertical portion of the flange formed on the outer periphery of the container body, wherein the connecting element is made of a resilient material allowing the diameter of the vertical cylindrical wall of the connecting element to enlarge when the cap is assembled on the container body, such that the enlarged vertical cylindrical wall of the connecting element exerts pressure on the flange formed on the outer periphery of the container body when the cap is assembled on the container body; and an active insert placed within the container body, the active insert defining at least a portion of the storage volume of the plastic container body.

2. The container according to claim 1, wherein the active insert is made of a material composition comprising a polymer and at least one active agent capable of interacting with at least one gaseous substance comprising moisture, oxygen or a volatile organic compound.

3. The container according to claim 1, wherein the flange has a portion extending outward from the side wall of the container body, the portion being a horizontal portion substantially perpendicular to the side wall of the container body.

4. The container according to claim 3, wherein the thickness of the horizontal portion of the flange is smaller than the thickness of the side wall of the container body, the thickness of the side wall being taken on an area adjacent to the horizontal portion.

5. The container according to claim 3, wherein a ratio between the thickness of the horizontal portion of the flange and the thickness of the side wall of the container body, taken on an area adjacent to the horizontal portion, is less than or equal to 2/3.

6. The container according to claim 3, wherein the flange further comprises a vertical portion extending vertically from an end of the horizontal portion of the flange.

7. The container according to claim 6, wherein the flange has an angular cross section at an angle of 90°.

8. The container according to claim 1, wherein the flange is a continuous peripheral flange.

9. The container according to claim 1, wherein a horizontal upper surface of a horizontal portion of the flange comprises a rounded or chamfered outer end.

10. The container according to claim 1, wherein the cap is a hinged cap comprising a hinge connecting the lid portion to the connecting element.

11. The container according to claim 10, wherein the cap is configured to cooperate with the side wall of the container body so as to form an airtight seal when the cap is in the closed position.

12. The container according to claim 11, having a moisture penetration rate of less than 1 mg/day at 40° C. and 75% relative humidity.

13. The container according to claim 11, having a moisture penetration rate of less than 10 μg/day/mm of seal length at 40° C. and 75% relative humidity.

14. The container according to claim 11, having a permeability to moisture of less than 220 mg·mm/m$^2$ day at 40° C. and 75% relative humidity.

15. A sealed package comprising at least one container according to claim 1, the package being substantially impermeable to gas including moisture or oxygen.

16. The sealed package according to claim 15, further containing a substance able to release moisture inside the sealed package.

17. The sealed package according to claim 16, wherein the substance is able to equilibrate the relative humidity inside the package at a substantially constant level of at least 2% rH at 20° C.

18. The sealed package according to claim 16, wherein the substance is a hydrated active agent, selected from silica gel, clay, deliquescent salt or a mixture thereof.

19. The container according to claim 1, wherein the active insert includes a side wall that covers at least a portion of the side wall of the plastic container body.

20. The container according to claim 1, wherein the pressure exerted on the flange formed on the outer periphery of the container body by the connecting element, when the cap is assembled on the container body, prevents vertical movement of the connecting element and prevents rotational movement of the connecting element around the flange.

21. The container according to claim 1, wherein the lid portion of the cap comprises a sealing skirt, wherein, when the cap is in the closed position, an upper edge of the active insert is positioned at a distance from a lower end of the sealing skirt in the vertical direction.

22. The container according to claim 1, wherein an inner surface of the container body comprises a peripheral cavity which cooperates with a bulge formed on a sealing skirt of the lid portion of the cap so as to form an airtight seal when the cap is in the closed position.

23. The container according to claim 1, wherein an upper circumferential portion of the active insert is tapered such that a thickness of the active insert at the upper circumferential portion thereof is less than a thickness of the active insert at lower circumferential portions thereof.

24. A method of manufacturing a container for packaging medical or pharmaceutical products, the container comprising a plastic container body comprising a side wall, a base and an opening defining a storage volume, the container further comprising (i) a cap comprising a lid portion configured to close the opening of the container body, a connecting element and a tamper-evident mechanism between the lid portion and the connecting element, (ii) a flange formed on an outer periphery of the container body, the flange being configured to receive the connecting element of the cap and to vertically secure the cap thereon, wherein, before the cap is assembled to the container body, a diameter of a vertical cylindrical wall of the connecting element is smaller than an outside diameter of a vertical portion of the flange formed on the outer periphery of the container body, wherein the connecting element is made of a resilient material allowing the diameter of the vertical cylindrical wall of the connecting element to enlarge when the cap is assembled on the container body, such that the enlarged vertical cylindrical wall of the connecting element exerts pressure on the flange formed on the outer periphery of the container body when the cap is assembled on the container body, and (iii) an active insert which is placed within the container body and defines at least a portion of the storage volume of the plastic container body, the method comprising:

supplying the container body with the active insert placed therein;

filling the container body with the medical or pharmaceutical products; and assembling the cap to the container body.

25. A method of using a container for packaging of medical or pharmaceutical products, the container comprising a plastic container body comprising a side wall, a base and an opening defining a storage volume, the container further comprising (i) a cap comprising a lid portion configured to close the opening of the container body, a connecting element and a tamper-evident mechanism between the lid portion and the connecting element, (ii) a flange formed on an outer periphery of the container body, the flange being configured to receive the connecting element of the cap and to vertically secure the cap thereon, wherein, before the cap is assembled to the container body, a diameter of a vertical cylindrical wall of the connecting element is smaller than an outside diameter of a vertical portion of the flange formed on the outer periphery of the container body, wherein the connecting element is made of a resilient material allowing the diameter of the vertical cylindrical wall of the connecting element to enlarge when the cap is assembled on the container body, such that the enlarged vertical cylindrical wall of the connecting element exerts pressure on the flange formed on the outer periphery of the container body when the cap is assembled on the container body, and (iii) an active insert which is placed within the container body and defines at least a portion of the storage volume of the plastic container body, the method comprising:

packaging medical or pharmaceutical products in the container.

* * * * *